US009683505B2

(12) United States Patent
Santillo et al.

(10) Patent No.: US 9,683,505 B2
(45) Date of Patent: Jun. 20, 2017

(54) IDENTIFICATION AND REJECTION OF ASYMMETRIC FAULTS

(71) Applicant: Ford Global Technologies, LLC, Dearborn, MI (US)

(72) Inventors: Mario Anthony Santillo, Canton, MI (US); Stephen William Magner, Farmington Hills, MI (US); Michael James Uhrich, West Bloomfield, MI (US); Mrdjan J. Jankovic, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 176 days.

(21) Appl. No.: 14/299,955

(22) Filed: Jun. 9, 2014

(65) Prior Publication Data

US 2015/0354485 A1 Dec. 10, 2015

(51) Int. Cl.
*F02D 41/04* (2006.01)
*F02D 41/22* (2006.01)
*F02D 41/14* (2006.01)

(52) U.S. Cl.
CPC ..... *F02D 41/04* (2013.01); *F02D 41/1441* (2013.01); *F02D 41/1454* (2013.01); *F02D 41/1456* (2013.01); *F02D 41/1495* (2013.01); *F02D 41/22* (2013.01); *F02D 2041/1409* (2013.01); *F02D 2041/1419* (2013.01);
(Continued)

(58) Field of Classification Search
CPC ..... F02D 41/04; F02D 41/12; F02D 41/123; F02D 41/126; F02D 41/14; F02D 41/1401; F02D 2041/1409; F02D 2041/141; F02D 2041/1418; F02D 2041/1419; F02D 2041/1432; F02D 41/1476; F02D 41/1495
USPC ..... 701/102, 103, 104, 109, 110, 112; 123/325, 339.12, 339.21, 672, 674, 675,
(Continued)

(56) References Cited

U.S. PATENT DOCUMENTS 4,843,556 A * 6/1989 Wakeman ..... F02D 41/1408 700/38
5,235,512 A * 8/1993 Winkelman ..... B60G 17/0165 123/352
(Continued)

OTHER PUBLICATIONS 160607 caltech.edu am06-pid_16Sep06.pdf.*
(Continued)

*Primary Examiner* — Carlos A Rivera
*Assistant Examiner* — Carl Staubach
(74) *Attorney, Agent, or Firm* — Julia Voutyras; McCoy Russell LLP

(57) ABSTRACT

Methods and systems are provided for identifying and rejecting asymmetric faults that cause engine emissions to be biased rich or lean. In one example, a method for an engine system comprises generating a UEGO sensor feedback set-point adjustment based on slower and faster time components within an outer loop of a catalyst control system; generating an inner-loop bias-offset correction from the slower time component; and indicating degradation of the engine system based on a comparison of the bias-offset correction to a degradation threshold. In this way, the total outer-loop control authority is increased while maintaining drivability and noise, vibration, and harshness (NVH) constraints and meeting emission standards in the presence of an air-to-fuel ratio biasing fault.

8 Claims, 7 Drawing Sheets

(52) U.S. Cl.
CPC ..... *F02D 2041/1431* (2013.01); *F02D 2041/1432* (2013.01)

(58) Field of Classification Search
USPC ..... 123/682, 697, 703, 704, 438; 60/285, 60/277, 276, 274
See application file for complete search history.

(56) References Cited

U.S. PATENT DOCUMENTS 5,359,852 A * 11/1994 Curran ..... F02D 41/2454 123/703
5,394,322 A * 2/1995 Hansen ..... G05B 13/045 700/32
5,609,136 A * 3/1997 Tuken ..... F02D 41/14 123/357
6,073,073 A * 6/2000 Kitamura ..... F02D 41/1402 123/698
6,804,618 B2 * 10/2004 Junk ..... G05B 23/0229 702/182
6,879,906 B2 * 4/2005 Makki ..... F01N 11/005 123/697
6,904,751 B2 * 6/2005 Makki ..... F01N 11/002 60/274
7,000,379 B2 * 2/2006 Makki ..... F01N 11/007 60/274
7,634,323 B2 * 12/2009 Vermillion ..... G05B 11/32 700/29
7,937,209 B2 * 5/2011 Dudek ..... F02D 41/0295 123/672
8,165,774 B2 * 4/2012 Wang ..... B60K 31/00 123/325
8,265,854 B2 * 9/2012 Stewart ..... G05B 13/048 700/19
9,359,967 B2 * 6/2016 Santillo ..... F02D 41/0295
2003/0155885 A1 * 8/2003 Zaremba ..... H02P 21/16 318/727
2007/0256406 A1 * 11/2007 Makki ..... F01N 11/007 60/277
2010/0174471 A1 * 7/2010 Nakayama ..... F02M 26/49 701/108
2012/0125301 A1 * 5/2012 Ide ..... F02D 41/005 123/568.21
2013/0231846 A1 * 9/2013 Magner ..... F02D 41/1441 701/108
2013/0245919 A1 * 9/2013 Kumar ..... F02D 41/0235 701/104
2015/0204258 A1 * 7/2015 Kumar ..... F01N 11/007 60/274
2015/0233315 A1 * 8/2015 Kumar ..... F02D 41/0295 60/274
2016/0018291 A1 * 1/2016 Uhrich ..... F02D 41/0085 73/114.69
2016/0061131 A1 * 3/2016 Santillo ..... F02D 41/0295 60/274

OTHER PUBLICATIONS 160609 caltech.edu Oct. 13, 2008 Internet Archive Wayback Machine.pdf.*
Allison, Bruce J. et al., "Design and Performance of Mid-Ranging Controllers," J. Process Control, vol. 8, pp. 469-474, 1998, 6 pages.
Gorzelic, P. et al., "A Coordinated Approach for Throttle and Wastegate Control in Turbocharged Spark Ignition Engines," In Proc. Chinese Ctrl. December Conference, pp. 1524-1529, Taiyuan, China, May 2012, 6 pages.

* cited by examiner

IDENTIFICATION AND REJECTION OF ASYMMETRIC FAULTS

BACKGROUND AND SUMMARY

Modern vehicles use three-way catalysts (TWC) for exhaust after-treatment of gasoline engines. With tightening government regulations on automobile emissions, feedback control is used to adequately regulate the engine air-to-fuel ratio (AFR). Some vehicles have a universal exhaust gas oxygen (UEGO) sensor upstream of the TWC and a heated exhaust gas oxygen (HEGO) sensor downstream of the TWC to control the AFR near stoichiometry. This is achieved by regulating the AFR to a set point around stoichiometry, which in turn is fine-tuned based on the deviation of a HEGO voltage from a pre-determined HEGO-voltage set-point.

However, various faults, such as AFR imbalance between cylinders, could bias the UEGO sensor reading rich or lean of stoichiometry. This can lead to significant feedgas emissions such as carbon monoxide (CO) or the oxides of nitrogen (NOx) passing directly to the tailpipe, as the biased air/fuel mixture is fed directly to the catalyst, overwhelming the oxygen-storage buffer that allows for short deviations from stoichiometry. These asymmetric faults may be caused, for example, by a degraded UEGO sensor, cylinder imbalance resulting from a degraded fuel injector, or an error incurred during a deceleration fuel shutoff event. Detecting and correcting for asymmetric biasing may include first running an intrusive diagnostics test, thereby increasing the risk of generating significant tailpipe emissions in the presence of an existing biasing fault.

The inventors herein have recognized the above issue and have devised various approaches to address it. In particular, systems and methods for identifying and rejecting asymmetric faults that cause engine emissions to be biased rich or lean are disclosed. In one example, a method for an engine system comprises: generating a UEGO sensor feedback set-point adjustment based on slower and faster time components within an outer loop of a catalyst control system; generating an inner-loop bias-offset correction from the slower time component; and indicating degradation of the engine system based on a comparison of the bias-offset correction to a degradation threshold. In this way, the total outer-loop control authority is increased while maintaining drivability and noise, vibration, and harshness (NVH) constraints and meeting emission standards in the presence of an air-to-fuel ratio biasing fault.

In another example, a method for controlling an internal combustion engine having an upstream exhaust gas sensor positioned upstream relative to a catalyst and a downstream exhaust gas sensor positioned downstream relative to a catalyst, comprises: generating an upstream exhaust gas sensor feedback set-point adjustment based on a downstream exhaust gas sensor feedback signal; monitoring the upstream exhaust gas sensor bias offset for a constant or slowly-varying bias; generating a bias-offset correction responsive to the constant or slowly-varying bias; adjusting the downstream exhaust gas sensor feedback signal with the bias-offset correction responsive to a temporal event. In this way, the generation of tailpipe emissions in the presence of an asymmetric biasing fault may be prevented.

In another example, a system for controlling an internal combustion engine, comprises: a first exhaust gas oxygen sensor positioned downstream relative to the engine; a catalyst positioned downstream relative to the first exhaust gas sensor; a second exhaust gas oxygen sensor positioned downstream relative to the catalyst; a controller in communication with the first and second exhaust gas oxygen sensors, the controller comprising an inner feedback control loop to control air-fuel ratio of the engine with feedback provided via the first exhaust gas oxygen sensor and an outer feedback control loop that modifies a reference air-fuel ratio provided to the inner feedback control loop based on feedback from the second exhaust gas oxygen sensor wherein the controller monitors the reference air-fuel ratio over time for a constant or slowly-varying bias and corrects the reference air-fuel ratio responsive to the constant or slowly-varying bias; and where the controller disables monitoring the reference air-fuel ratio for a pre-determined amount of time responsive to a deceleration fuel shutoff event. In this way, asymmetric biasing faults may be properly identified and rejected without the need for intrusive diagnostics tests.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
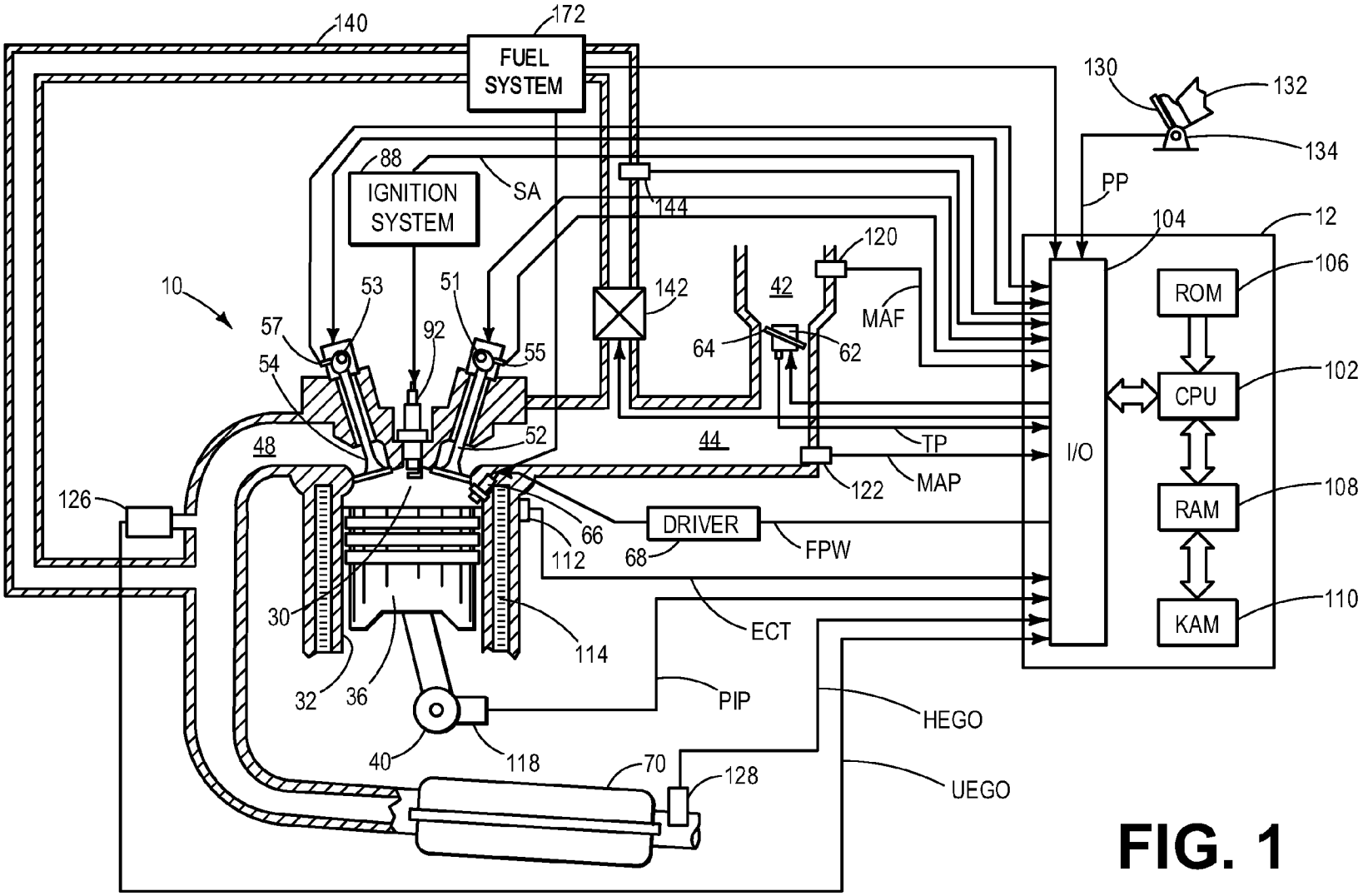
FIG. 1 shows a schematic depiction of an engine and an associated exhaust emissions system.
Figure 3A:
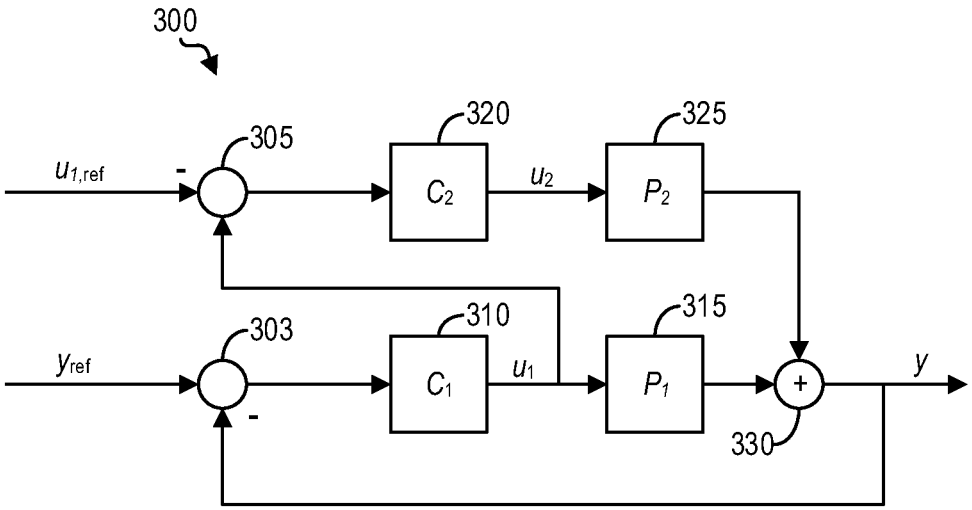
FIG. 3A shows a block diagram illustrating an example mid-ranging control system.
Figure 3B:
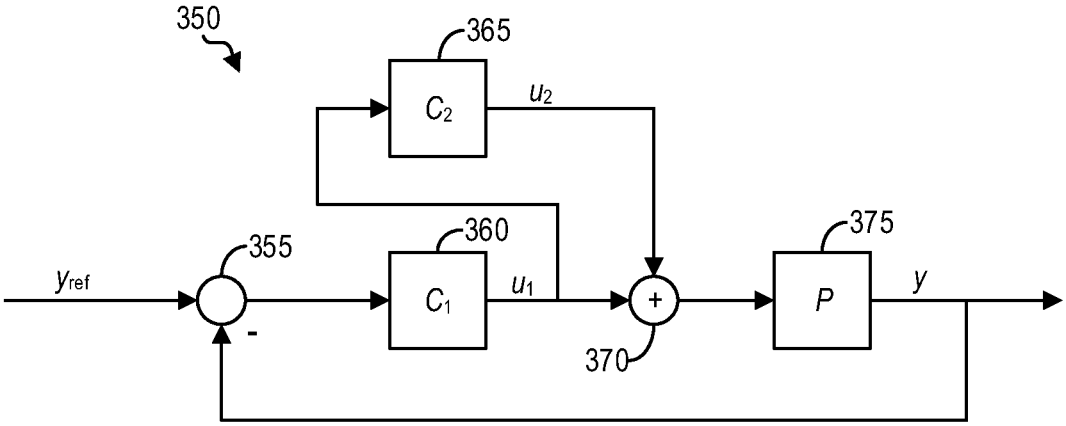
FIG. 3B shows a block diagram illustrating an example modified mid-ranging control system for the outer loop.
Figure 4:
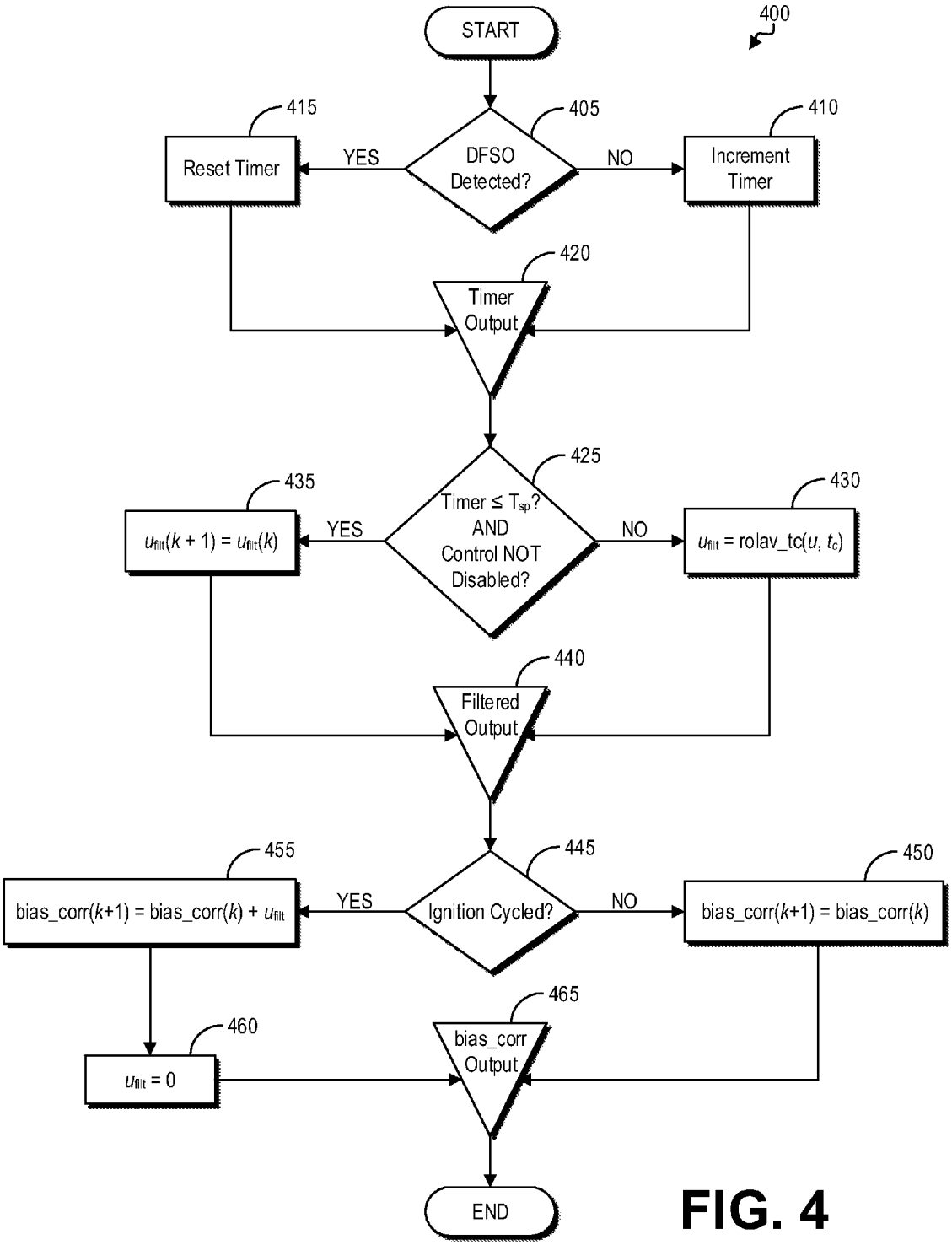
FIG. 4 shows a high-level flow chart illustrating an example passive-feedback method using a fast-and-slow control to generate an outer-loop bias correction.
Figure 5:
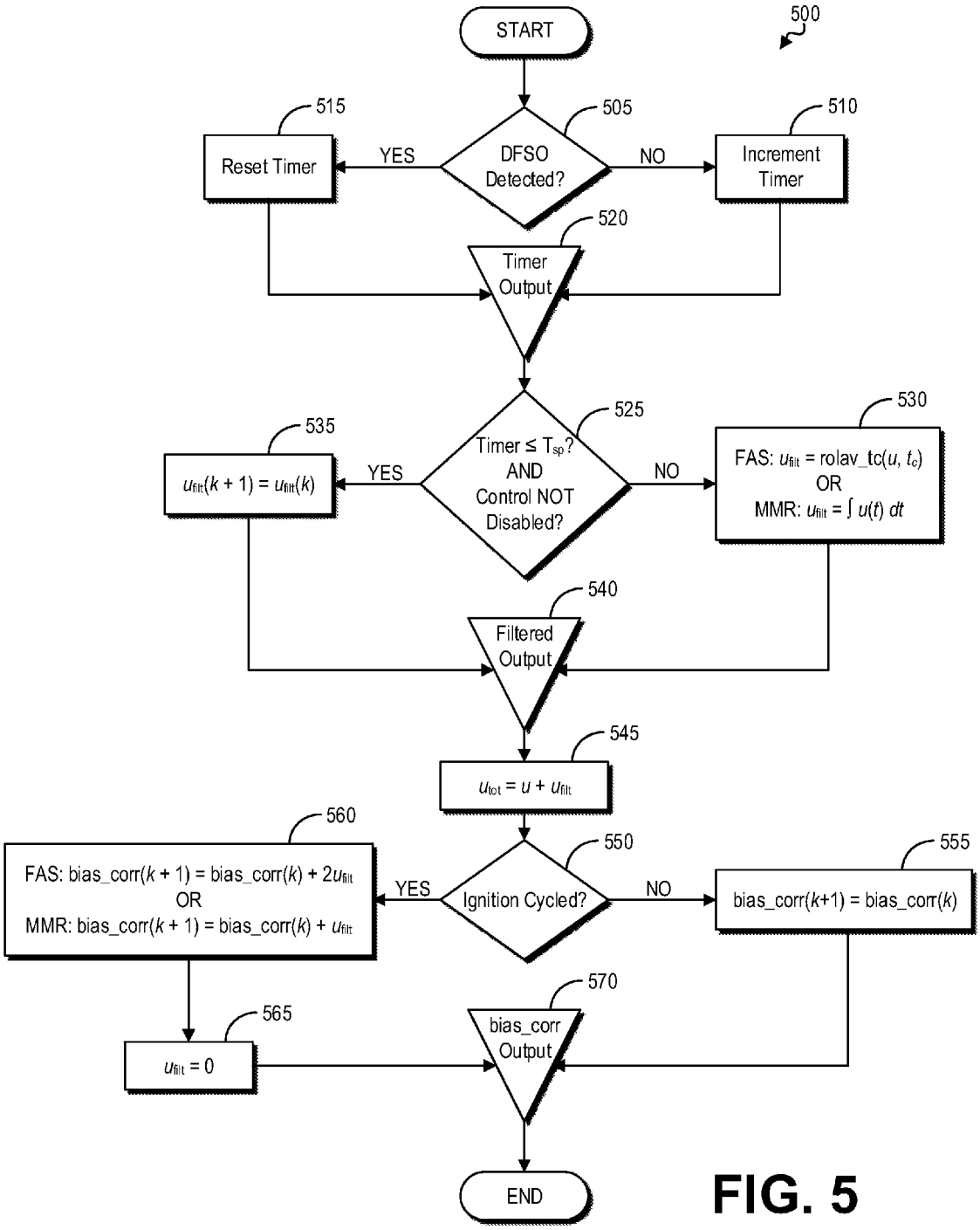
FIG. 5 shows a high-level flow chart illustrating an example active-feedback method using either a fast-and-slow control or a modified mid-ranging control to generate an outer-loop bias correction.
Figure 6:
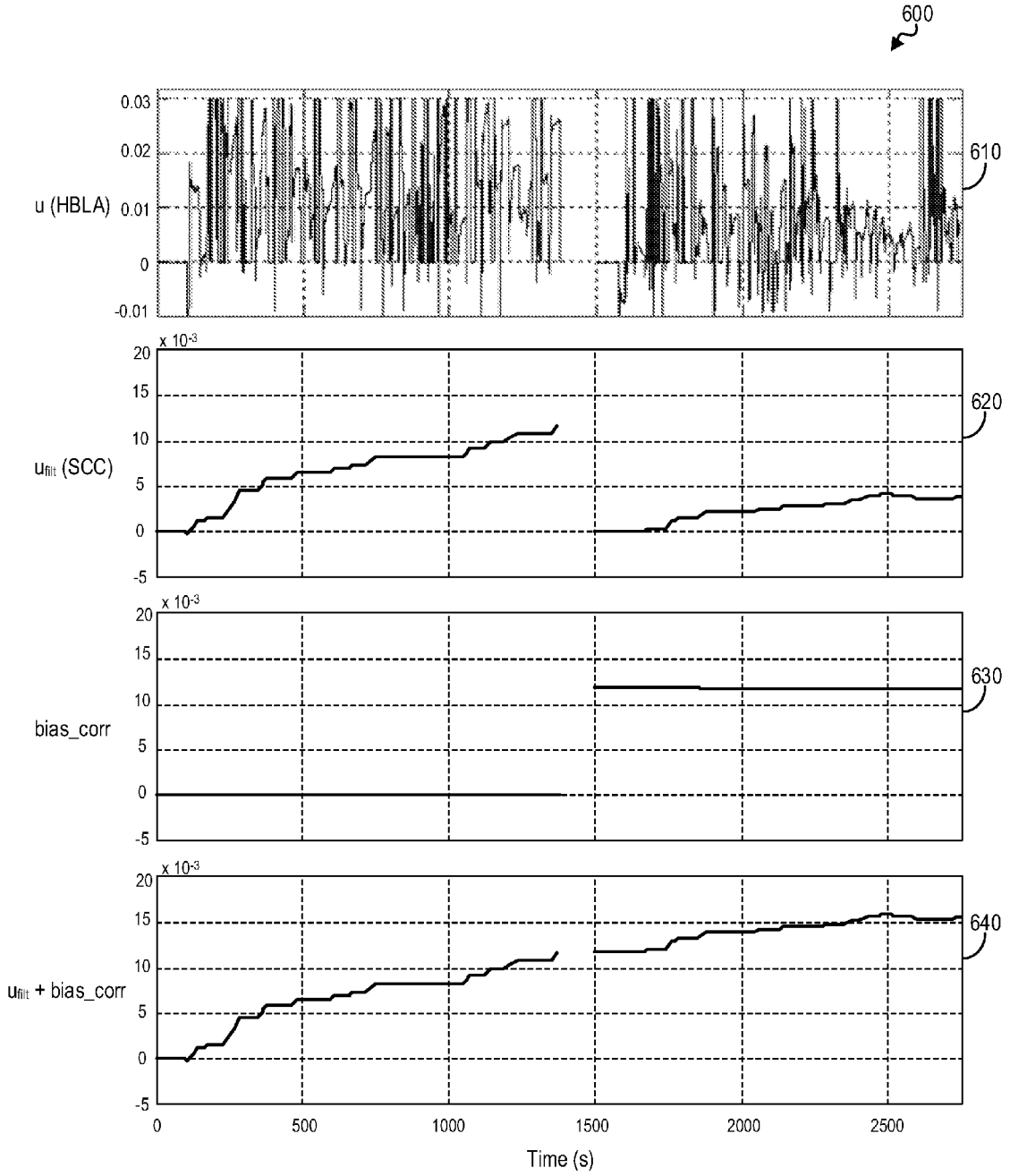
FIG. 6 shows a set of graphs illustrating a long-term outer-loop control action for an example passive-feedback method using a fast-and-slow control to generate an inner-loop set-point adjustment in accordance with the present disclosure.
Figure 7:
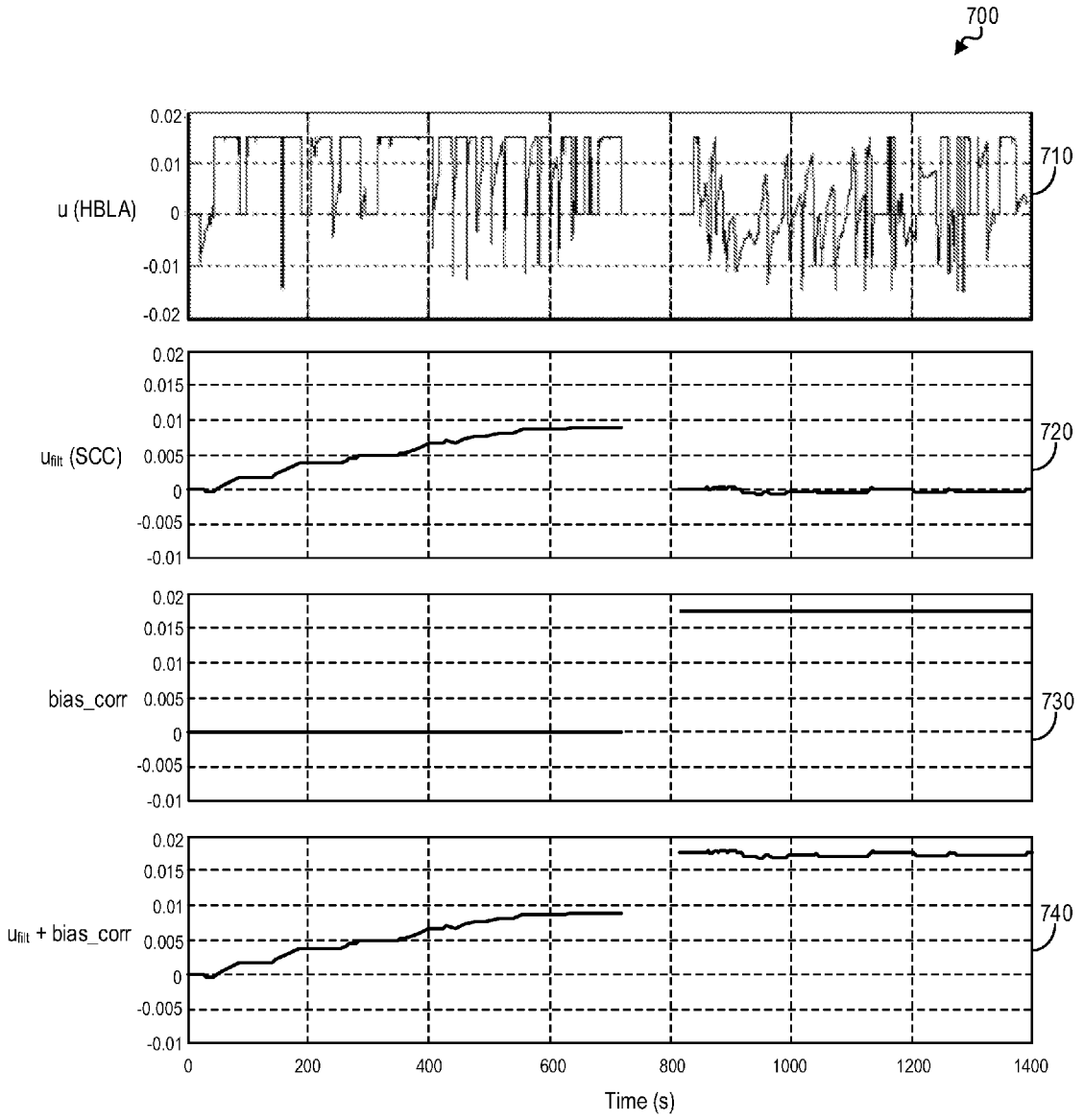
FIG. 7 shows a set of graphs illustrating a long-term outer-loop control action for an example active-feedback method using a fast-and-slow control to generate an inner-loop set-point adjustment in accordance with the present disclosure.

The following description relates to systems and methods for identifying and rejecting asymmetric faults in an exhaust after-treatment system of a vehicle. As shown in FIG. 1, the vehicle may be configured with a three-way catalyst for exhaust after-treatment in addition to exhaust gas oxygen sensors upstream and downstream of the catalyst. These exhaust gas oxygen sensors may comprise a catalyst control architecture including inner and outer control loops, such as the one shown in FIG. 2. A generic mid-ranging control architecture is shown in FIG. 3A and is modified for outer loop control, as shown in FIG. 3B. In the modified approach, the control action of the outer loop is monitored over time in order to identify and reject asymmetric faults. Following a deceleration fuel shutoff event, the catalyst is necessarily biased rich to regenerate the catalyst from a saturated oxygen state. This process of catalyst regeneration will interfere with appropriately monitoring the outer loop control action, and so this feature of the outer loop controller may be temporarily disabled following a deceleration fuel shutoff event. Routines for monitoring and updating the outer loop control action that are disabled during catalyst regeneration are shown in FIGS. 4 and 5. Timelines demonstrating the outer loop controller action are shown in FIGS. 6 and 7.

FIG. 1 illustrates a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 1, intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

An upstream exhaust gas sensor 126 is shown coupled to exhaust passage 48 upstream of emission control device 70. Upstream sensor 126 may be any suitable sensor for providing an indication of exhaust gas air-fuel ratio such as a linear wideband oxygen sensor or UEGO (universal or wide-range exhaust gas oxygen), a two-state narrowband oxygen sensor or EGO, a HEGO (heated EGO), a NOx, HC, or CO sensor. In one embodiment, upstream exhaust gas sensor 126 is a UEGO configured to provide output, such as a voltage signal, that is proportional to the amount of oxygen present in the exhaust. Controller 12 uses the output to determine the exhaust gas air-fuel ratio.

Emission control device 70 is shown arranged along exhaust passage 48 downstream of exhaust gas sensor 126. Device 70 may be a three way catalyst (TWC), configured to reduce NOx and oxidize CO and unburnt hydrocarbons. In some embodiments, device 70 may be a NOx trap, various other emission control devices, or combinations thereof.

A second, downstream exhaust gas sensor 128 is shown coupled to exhaust passage 48 downstream of emissions control device 70. Downstream sensor 128 may be any suitable sensor for providing an indication of exhaust gas air-fuel ratio such as a UEGO, EGO, HEGO, etc. In one embodiment, downstream sensor 128 is a HEGO configured to indicate the relative enrichment or enleanment of the exhaust gas after passing through the catalyst. As such, the HEGO may provide output in the form of a switch point, or the voltage signal at the point at which the exhaust gas switches from lean to rich.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure (MAP) signal from sensor 122. Engine speed signal, RPM, may be generated by controller 12 from signal PIP.

Storage medium read-only memory 106 can be programmed with computer readable data representing non-transitory instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

Figure 2:
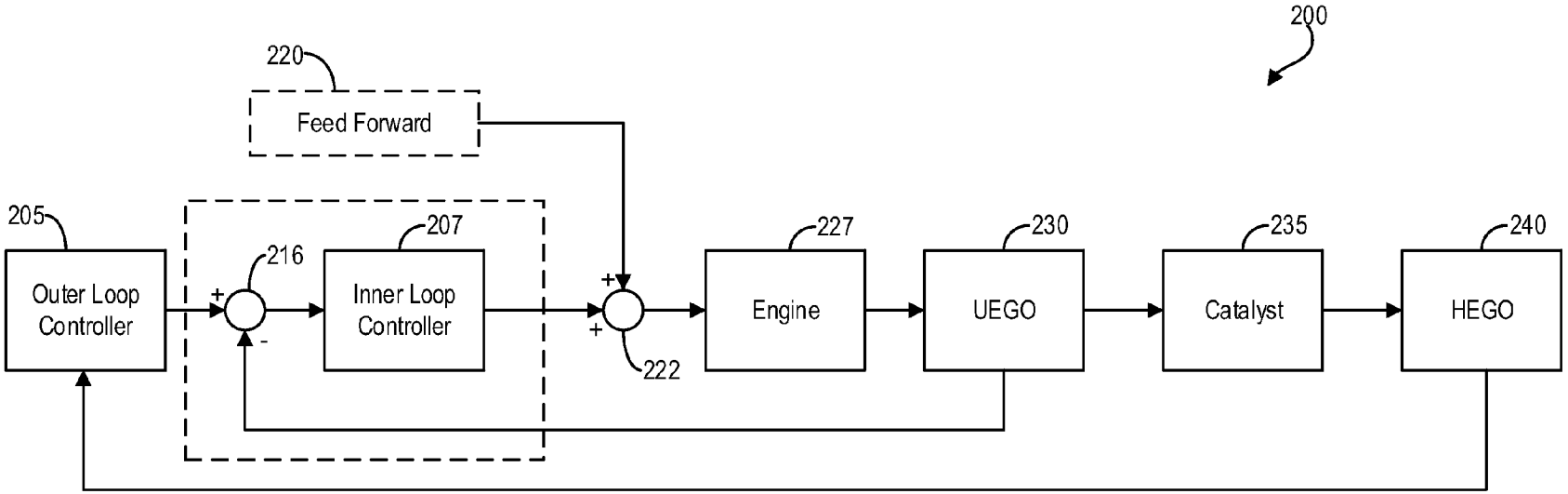
FIG. 2 shows a block diagram illustrating an example catalyst control architecture.

FIG. 2 is a block diagram illustrating the inner and outer feedback control loops for a catalyst control architecture 200 implemented by an engine controller, such as controller 12, in accordance with the current disclosure. Catalyst control architecture 200 includes a universal exhaust gas oxygen (UEGO) sensor 230 upstream of a three-way catalyst (TWC) 235 and a heated exhaust gas oxygen (HEGO) sensor 240 downstream of TWC 235. Catalyst control architecture 200 regulates the air-to-fuel ratio (AFR) to a set point near stoichiometry and fine-tunes this regulation based on the deviation of a HEGO voltage from a pre-determined HEGO-voltage set point. Inner loop controller 207 uses the upstream UEGO sensor for higher-bandwidth feedback control while outer loop controller 205 uses the HEGO sensor for lower-bandwidth control.

Inner loop controller 207, comprising a proportional-integral-derivative (PID) controller, controls the engine AFR by generating an appropriate fuel command (e.g., fuel pulse width). Summing junction 222 combines the fuel command from inner loop controller 207 with commands from a feed forward controller 220. This combined set of commands is delivered to the fuel injectors of engine 227. UEGO sensor 230 provides a feedback signal to the inner loop controller 207, the UEGO feedback signal proportional to the oxygen content of the feedgas or engine exhaust between the engine 227 and the TWC 235. Outer loop controller 205 generates a UEGO reference signal provided to the inner loop controller 207. The UEGO reference signal is combined with the UEGO feedback signal at junction 216. The error or difference signal provided by junction 216 is then used by inner loop controller 207 to adjust the fuel command so that the actual AFR within engine 227 approaches the desired AFR. HEGO sensor 240 provides a feedback signal to the outer loop controller 205.

In the preferred embodiment, outer loop controller 205 is a proportional-integral (PI) controller where the integral control action is split between short- and long-term pieces. Outer loop controller 205 may be any reasonable controller containing an integral term. The short-term integral control action is used to provide a fast correction to the UEGO reference signal output by outer loop controller 205. The output UEGO AFR reference signal should nominally hover near one and only bias larger or smaller in the presence of an air-to-fuel ratio biasing fault. Meanwhile, the long-term integral control action is used to provide slow correction to the UEGO reference signal output by outer loop controller 205. This corrective action allows the outer loop controller 205 to maintain limited instantaneous range of control authority to meet drivability and noise, vibration, and harshness (NVH) constraints while simultaneously rejecting constant or slowly varying disturbances beyond its instantaneous range of authority. In this manner, the overall range of outer-loop control authority is effectively increased.

In one embodiment, the slow-correction component (SCC) is generated by filtering the output from outer loop controller 205 with a calibratable low-pass filter. The SCC output is used to passively or actively adjust the inner-loop bias-offset. This enables monitoring of the average long-term bias correction, if any, being applied by outer loop controller 205. Updating of the SCC is disabled for a calibratable amount of time following a deceleration fuel shutoff (DFSO) event and subsequent catalyst reactivation so as to avoid unwarranted bias correction. Example approaches for updating the SCC and actively or passively adjusting the inner-loop bias-offset in this manner are further described herein and with regards to FIGS. 4 and 5. In this embodiment, the combination of a high-bandwidth limited-authority controller and a low-pass filter is called a fast-and-slow (FAS) controller. An outer loop controller including a calibratible low-pass filter is further described herein and with regard to FIG. 3B.

In another embodiment, the outer loop controller 205 comprises a modified mid-range (MMR) controller. The MMR controller generates a SCC using an integrator instead of a low-pass filter. The SCC output is used to adjust the inner-loop bias-offset on a regular interval in a pre-determined manner, which may include after each drive cycle, when a specified amount of time has passed, or real time. This enables monitoring of the average long-term bias correction, if any, being applied by outer loop controller 205. A degradation threshold may be established such that the presence of a long-term bias correction indicates an air-to-fuel ratio biasing fault. In this way, a biasing fault may be identified, possibly triggering additional logic to isolate the specific fault. Whether or not such additional logic is implemented, outer loop controller 205 may actively reject the biasing fault through long-term inner-loop bias-offset correction. Updating of the SCC is also disabled for a calibratable amount of time following a DFSO event and subsequent catalyst reactivation so as to avoid unwarranted bias correction. Updating the SCC and actively adjusting the inner-loop bias-offset in this manner is further described herein and with regard to FIG. 5. An outer loop controller comprising a modified mid-range controller is further described herein and with regard to FIG. 3B.

FIG. 3A is a block diagram illustrating a generic mid-ranging controller 300, arranged in a two-input configuration with slow and fast components. The fast component is a high-bandwidth control signal for commanding an immediate sensor feedback adjustment. The slow component is a low-bandwidth control signal that accounts for any constant or slowly-varying biases.

In one embodiment, controller 310 is a PI controller. In other embodiments, controller 310 may be any reasonable controller containing an integral term. Junction 303 generates an error signal based upon the difference of reference signal $y_{ref}$ and feedback signal y. Note that reference signal $y_{ref}$ is a feed-forward signal, while feedback signal y is measured. Controller 310 receives the error signal from junction 303 and computes a fast-correction component $u_1$ comprising an adjusted reference signal. Fast-correction component $u_1$ is input to plant 315. Fast-correction component $u_1$ is also input to junction 305, where an error signal based on fast-correction component $u_1$ and reference signal $u_{1,ref}$ is computed. The error signal from junction 305 is input to controller 320. Controller 320 filters the adjusted fast-correction component and generates a slow-correction component $u_2$. Plant 325 converts the filtered command $u_2$ into a bias-offset signal. At junction 330, bias-offset signal from plant 325 and output from plant 315 are combined into signal y.

FIG. 3B is a block diagram illustrating a modified mid-range controller 350 in accordance with the current disclosure. In contrast to conventional mid-ranging control structures comprising a slow-fast two-input configuration, such as the controller described hereinabove with regard to FIG. 3A, the modified mid-range controller 350 includes a single input with both slow and fast components.

In one embodiment, controller 360 is a PI controller. In other embodiments, controller 360 may be any reasonable controller containing an integral term. Junction 355 generates an error signal based upon the difference of reference signal $y_{ref}$ and feedback signal y. Note that reference signal $y_{ref}$ is a feed-forward HEGO voltage signal while feedback signal y is a measured HEGO voltage signal. Controller 360 receives the error signal from junction 355 and computes a fast-correction component $u_1$ comprising an adjusted UEGO sensor feedback set-point. Fast-correction component $u_1$ is output to controller 365 and junction 370.

In one embodiment, controller 365 is an integrator. In another embodiment, controller 365 may be a low-pass filter. In both embodiments, controller 365 filters the fast-correction component $u_1$ to produce a slow-correction component $u_2$. Slow-correction component $u_2$ is combined with fast-correction component $u_1$ at junction 370. The fully-corrected signal from junction 370 is then input to plant 375, plant 375 comprising the catalyst control architecture of FIG. 2 excluding the outer-loop controller.

Hence, controller 350 is a closed-loop controller that allows either passive- or active-feedback correction. Methods for controller 350 are discussed further herein and with regard to FIGS. 4 and 5. The practical result of implementing controller 350 is discussed further herein and with regard to FIGS. 6 and 7.

After monitoring the average long-term control action of the outer-loop PI-type controller, the resulting output can be used in one of two ways. In one embodiment, the method for using the resulting output is a passive-feedback correction, that is, the long-term control action of the outer-loop controller is passively monitored. At the end of a cycle (for example, a pre-determined time, when the vehicle ignition is turned off, etc.), the resulting passively-monitoring output value $u_{filt}$ is used to update the inner-loop bias-offset (bias_corr), which remains constant over the cycle. In another embodiment, an active-feedback bias correction method may be implemented. In this embodiment, as the low-pass filter (or in some embodiments, the integrator) monitors the long-term control action of the outer-loop controller, the total control output $u_{tot}$ is calculated as the sum of the outer-loop control action u and the SCC output $u_{filt}$. In both passive and active implementations, the corrective action allows the total outer-loop control authority to be effectively increased, and hence, maintaining reasonable limits of operation to meet drivability constraints while simultaneously rejecting constant or slowly-varying disturbances beyond its instantaneous range of authority. In all embodiments, the SCC may be applied to either the inner-loop controller's reference signal or directly to the UEGO feedback sensor measurement itself, as the net sum input to the inner loop controller 207 is equivalent, as shown in summing junction 216 in FIG. 2.

FIG. 4 is a high-level flow chart illustrating an example passive-feedback method 400 using a fast-and-slow outer-loop controller to generate an outer-loop bias correction. Method 400 may be implemented with the fast-and-slow outer-loop controller as described hereinabove with regard to FIG. 3B.

Method 400 may begin at 405. At 405, method 400 may include detecting a deceleration fuel shutoff event. Following a DFSO event, the catalyst control is necessarily biased rich to regenerate the catalyst from a saturated oxygen storage state. To avoid this rich bias effect from affecting the SCC output, the long-term control action must be disabled from monitoring for a pre-determined length of time $T_{sp}$ following a DFSO event. To that end, when a DFSO event occurs, an incrementing timer is triggered and is reset only upon beginning the next DFSO event. Therefore, if a DFSO event is not detected, method 400 proceeds to 410. At 410, a timer is incremented. If a DFSO event is detected, method 400 proceeds to 415. At 415, the timer is reset. The timer output is then output at 420.

Method 400 may then continue to 425. At 425, the timer output is compared to a calibratable timer set-point $T_{sp}$ and the status of the control is evaluated. If the timer output is greater than the timer set-point $T_{sp}$ or the outer-loop control is disabled, method 400 may proceed to 430. At 430, the filtered output $u_{filt}$ is updated by filtering the outer-loop control action u through a first-order low-pass filter with time constant $t_c$, $u_{filt}$=rolav_tc(u, $t_c$). However, if the timer output is less than or equal to the timer set-point and the outer loop control is not disabled, method 400 may proceed to 435. At 435, the filtered output remains the same; that is, $u_{filt}(k+1) = u_{filt}(k)$. After either case, the filtered output $u_{filt}$ is then output at 440.

Continuing at 445, method 400 may include determining if the end of an ignition cycle has occurred. In some embodiments, method 400 may alternatively include determining if the end of a specified cycle has occurred, for example the cycle may comprise a calibratable amount of time. If the ignition has not yet been cycled, method 400 may then continue to 450. At 450, the bias-offset correction may be set to its previous value, for example bias_corr(k+1)=bias_corr(k). The bias offset may then be output at 465, and method 400 may then end. However, if the ignition has been cycled, method 400 may continue to 455. At 455, the bias offset bias_corr may be updated by adding the filtered output $u_{filt}$ to the previous bias offset, for example bias_corr (k+1)=bias_corr(k)+$u_{filt}$. Following this update to the bias offset, method 400 may then continue to 460. At 460, the low-pass filter states are reset to zero for the next cycle, $u_{filt}$=0. The bias offset is then output at 465. In some embodiments, the bias offset may then be compared to a degradation threshold. If the bias offset is above the degradation threshold, controller 212 may indicate a degradation of the engine system. Controller 212 may not indicate a degradation of the engine system until the bias offset is above the degradation threshold for a pre-determined period of time. Method 400 may then end.

FIG. 5 is a high-level flow chart illustrating an example active-feedback method 500 using either a fast-and-slow control or a modified mid-ranging control to generate an outer-loop bias correction. Method 500 may be implemented in closed loop with either a low-pass filter or an integrator to generate the SCC, as described herein and with regard to FIG. 3B.

Method 500 may begin at 505. At 505, method 500 may include detecting if a DFSO event has occurred. If a DFSO event has not occurred, method 500 may continue to 510. At 510, a timer is incremented. If a DFSO event has occurred, method 500 may continue to 515. At 515, the timer is reset. At 520, the timer output is output. Method 500 may then continue to 525.

At 525, method 500 may include comparing the timer output to a calibratable timer set-point $T_{sp}$ and evaluating the outer-loop controller status. If the timer output is greater than the timer set-point $T_{sp}$ or the outer-loop controller is disabled, then method 500 may continue to 530. At 530, if the outer-loop controller is a FAS controller, the SCC output $u_{filt}$ is updated by filtering the outer-loop control action u through a first-order low-pass filter with calibratable time constant $t_c$, $u_{filt}$=rolav_tc(u, $t_c$). If the outer-loop controller is a MMR controller, the SCC output $u_{filt}$ is updated by filtering the outer-loop control action u through an integrator, $u_{filt}=\int u(t)\,dt$. The filtered output $u_{filt}$ may then be output at 540. If the timer output is less than or equal to the timer set-point $T_{sp}$ and the outer-loop controller is not disabled, method 500 may continue to 535. At 535, the filtered output $u_{filt}$ remains unchanged, $u_{filt}(k+1)=u_{filt}(k)$. The filtered output $u_{filt}$ is then output at 540. Method 500 may then continue to 545.

At 545, method 500 may include generating the total control output $u_{tot}$ by adding the SCC output $u_{filt}$ to the outer-loop control u. In this way, the long-term control action of the outer-loop controller is actively monitored. Method 500 may then continue to 550.

At 550, method 500 may include determining if the end of an ignition cycle has occurred. In some embodiments, method 500 may alternatively include determining if the end of a specified cycle has occurred, for example the cycle may comprise a calibratable amount of time. If the ignition has not yet been cycled, method 500 may then continue to 555. At 555, the bias-offset correction bias_corr may be set to its previous value, for example bias_corr(k+1)=bias_corr(k). The bias offset may then be output at 570, and method 500 may then end. However, if the ignition has been cycled, method 500 may continue to 560. At 560, the bias offset bias_corr may be updated by adding the filtered output $u_{filt}$ to the previous bias offset. In embodiments using an integrator to monitor the long-term control action, for example, the bias-offset correction is bias_corr(k+1)=bias_corr(k)+$u_{filt}$. In embodiments using a low-pass filter to monitor the long-term control action, however, the bias-offset correction is bias_corr(k+1)=bias_corr(k)+2$u_{filt}$. Bias offset bias_corr is updated with twice the filtered output due to the fact that when the low-pass filter is implemented in closed-loop with PI controller 360, the resulting identified bias is only half the true disturbance offset. Following this update to the bias offset, method 500 may then continue to 565. At 565, the SCC states are reset to zero for the next cycle, $u_{filt}$=0. The bias offset is then output at 570. In some embodiments, the bias offset may then be compared to a degradation threshold. If the bias offset is above the degradation threshold, controller 212 may indicate a degradation of the engine system. Controller 212 may not indicate a degradation of the engine system until the bias offset is above the degradation threshold for a pre-determined period of time. Finally, method 500 may end.

FIG. 6 is a set of graphs 600 illustrating the outer-loop control action for an example passive-feedback method using a fast-and-slow control to generate an inner-loop bias correction in accordance with the present disclosure. A Federal Test Procedure drive cycle, specifically FTP75, is shown for a UEGO six-pattern rich-to-lean delay fault with magnitude 500 ms. In this case, the passive-feedback method of bias correction is used with FAS control, as described herein and with regard to FIG. 4.

Graph 610 shows a plot of the fast portion of the outer-loop controller action u as a function of time. Outer-loop controller action u corresponds to the high-bandwidth limited-authority (HBLA) correction component $u_1$ described herein and with regard to FIG. 3B. Graph 620 shows a plot of the filtered outer-loop control action output $u_{filt}$ as a function of time. Filtered output $u_{filt}$ corresponds to the slow-correction component $u_2$ described herein and with regard to FIG. 3B. Graph 630 shows a plot of bias offset bias_corr as a function of time. Graph 640 shows a plot of the updated slow-correction component $u_{filt}$+bias_corr as a function of time.

Initially, bias_corr is set to zero and $u_{filt}$ is calculated from the long-term average of the fast portion of the outer-loop control action. When the vehicle is turned off around 1400 seconds, the final recorded value of $u_{filt}$ is used to update bias_corr, that is, bias_corr(k+1)=bias_corr(k)+$u_{filt}$=$u_{filt}$=0.011. Following this update, $u_{filt}$ is reset to zero for the next cycle. During the second drive cycle, the updated bias_corr helps partially unbias the UEGO sensor reading, leading to a smaller $u_{filt}$ value being learned, since the fast portion of the outer-loop controller does not need to bias as rich to correct for the lean fault. At the end of the second drive cycle, bias_corr is again updated from the final learned $u_{filt}$ value, resulting in an overall 1.5% rich bias. Finally, $u_{filt}$ is again reset to zero for the next cycle.

FIG. 7 is a set of graphs 700 illustrating the outer-loop control action for an example active-feedback method using a fast-and-slow control to generate an inner-loop bias correction in accordance with the present disclosure. In this example, a test cycle is run with a UEGO six-pattern rich-to-lean delay fault with magnitude 800 ms. In this case, the active-feedback method of bias correction with FAS control is used, as described herein and with regard to FIG. 5.

Graph 710 shows a plot of outer-loop controller action u as a function of time. Outer-loop controller action u corresponds to the high-bandwidth limited-authority (HBLA) correction component $u_1$ described herein and with regard to FIG. 3B. Graph 720 shows a plot of the filtered outer-loop control action output $u_{filt}$ as a function of time. Filtered output $u_{filt}$ corresponds to the slow-correction component $u_2$ described herein and with regard to FIG. 3B. Graph 730 shows a plot of bias offset bias_corr as a function of time. Graph 740 shows a plot of the updated slow-correction component $u_{filt}$+bias_corr as a function of time.

Initially, bias_corr is set to zero and $u_{filt}$ is calculated from the long-term average of the outer-loop control action, which is clipped at ±1.5%. When the vehicle is turned off around 700 seconds, the final recorded value of $u_{filt}$ is used to update bias_corr, that is, bias_corr(k+1)=bias_corr(k)+2$u_{filt}$=0.0176. Following this update, $u_{filt}$ is reset to zero for the next cycle. During the second drive cycle, the updated bias_corr helps unbias the UEGO sensor reading, and ultimately, the outer-loop control action. This can be observed by comparing the fast-correction signal in graph 710 before and after bias_corr update (i.e., to the left and to the right of 800 sec time), where after the update the signal u is more centered and does not run as often to the actuation limits. In this manner, the instantaneous outer-loop control action can remain clipped at ±1.5% to meet drivability constraints while simultaneously maintaining a long-term bias to correct for the faulted condition. Note that the control action necessary to reject this 800 ms rich-to-lean delay fault is greater than the outer-loop controller's instantaneous range of authority, and hence $u_{filt}$ is necessary for maintaining an unbiased control while meeting drivability constraints.

As one embodiment, a method for an engine system comprises generating a UEGO sensor feedback set-point adjustment based on slower and faster time components within an outer loop of a catalyst control system; generating an inner-loop bias-offset correction from the slower time component; and indicating degradation of the engine system based on a comparison of the bias-offset correction to a degradation threshold. The method uses an outer loop HEGO sensor and a proportional-plus-integral controller, and further includes adjusting an air-fuel ratio based on the UEGO sensor feedback set-point adjustment. Generating the UEGO sensor feedback set-point adjustment using the faster and slower time components comprises summing the faster time component and the slower time component.

In one example, generating the faster and slower time components comprises generating a first error based on a difference between a reference HEGO sensor signal and a HEGO sensor signal, generating the faster time component based on the first error, and generating the slower time component by filtering the faster component. In one example, filtering the faster component is performed by a low-pass filter.

In another example, the inner-loop bias-offset correction is determined based on a value of the slower time component. The value of the slower time component is added to the inner-loop bias-offset correction at the end of an ignition cycle. The inner-loop bias-offset correction is applied to the UEGO sensor feedback set-point adjustment as a bias offset responsive to an end of an ignition cycle.

In yet another example, the method further comprises disabling the generation of the slower component correction responsive to a deceleration fuel shutoff event for a pre-determined time period. In one example, the pre-determined time period is an ignition cycle.

In another embodiment, a method for controlling an internal combustion engine having an upstream exhaust gas sensor positioned upstream relative to a catalyst and a downstream exhaust gas sensor positioned downstream relative to a catalyst comprises generating an upstream exhaust gas sensor feedback set-point adjustment based on a downstream exhaust gas sensor feedback signal, monitoring the upstream exhaust gas sensor feedback set-point adjustment for a constant or slowly-varying bias, generating a bias-offset correction responsive to the constant or slowly-varying bias, and adjusting the downstream exhaust gas sensor feedback signal with the bias-offset correction responsive to a temporal event.

In one example, the upstream exhaust gas sensor is a universal exhaust gas oxygen sensor and the downstream exhaust gas sensor is a heated exhaust gas oxygen sensor.

In another example, the upstream exhaust gas sensor feedback set-point adjustment comprises a fast component and a slow component. In this example, monitoring the upstream exhaust gas sensor feedback set-point adjustment for a constant or slowly-varying bias comprises filtering the fast component. Further, filtering the fast component of the upstream exhaust gas sensor feedback set-point adjustment is performed by an integrator.

The method further comprises disabling the generation of the bias-offset correction responsive to a deceleration fuel shut-off event for a pre-determined time period.

As another embodiment, a system for controlling an internal combustion engine comprises a first exhaust gas oxygen sensor positioned downstream relative to the engine; a catalyst positioned downstream relative to the first exhaust gas sensor; a second exhaust gas oxygen sensor positioned downstream relative to the catalyst; and a controller in communication with the first and second exhaust gas oxygen sensors, the controller comprising an inner feedback control loop to control air-fuel ratio of the engine with feedback provided via the first exhaust gas oxygen sensor and an outer feedback control loop that modifies a reference air-fuel ratio provided to the inner feedback control loop based on feedback from the second exhaust gas oxygen sensor wherein the controller monitors the reference air-fuel ratio over time for a constant or slowly-varying bias and corrects the reference air-fuel ratio responsive to the constant or slowly-varying bias; and where the controller disables monitoring the reference air-fuel ratio for a pre-determined amount of time responsive to a deceleration fuel shutoff event. In one example, the upstream exhaust gas oxygen sensor is a universal exhaust gas oxygen sensor and the downstream exhaust gas oxygen sensor is a heated exhaust gas oxygen sensor.

In one example, the controller uses a low-pass filter to monitor the reference air-fuel ratio. In another example, the controller uses an integrator to monitor the reference air-fuel ratio.

In yet another example, the outer feedback control loop comprises a modified mid-ranging controller.

Note that the example control and estimation routines included herein can be used with various engines and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

with a controller of an engine system, generating an error based on a difference between a reference HEGO sensor signal and a HEGO sensor signal;

generating a faster time component based on the error;

generating a slower time component by filtering the faster time component;

generating a UEGO sensor feedback set-point adjustment based on the slower and faster time components within an outer loop of a catalyst control system;

generating an inner-loop bias-offset correction from the slower time component;

indicating degradation of the engine system based on a comparison of the inner-loop bias-offset correction to a degradation threshold; and delivering a command to a fuel injector to adjust an engine air-fuel ratio based on the UEGO sensor feedback set-point adjustment.

2. The method of claim 1, wherein the HEGO sensor signal is from an outer loop HEGO sensor, and wherein the controller is a proportional-plus-integral controller.

3. The method of claim 1, wherein filtering is performed by a low-pass filter.

4. The method of claim 1, wherein a value of the slower time component is added to the inner-loop bias-offset correction by the controller at an end of an ignition cycle.

5. The method of claim 1, wherein generating the UEGO sensor feedback set-point adjustment using the faster and slower time components comprises summing the faster time component and the slower time component.

6. The method of claim 1, wherein the inner-loop bias-offset correction is applied to the UEGO sensor feedback set-point adjustment as a bias offset responsive to an end of an ignition cycle.

7. The method of claim 1, further comprising, with the controller, disabling the generation of the slower time component correction responsive to a deceleration fuel shutoff event for a pre-determined time period.

8. The method of claim 7, wherein the pre-determined time period is an ignition cycle.

* * * * *